US007931492B1

(12) United States Patent
Chen

(10) Patent No.: US 7,931,492 B1
(45) Date of Patent: Apr. 26, 2011

(54) STRUCTURE OF CONDUCTIVE TERMINAL OF ELECTRICAL CONNECTOR

(75) Inventor: Yen-Lin Chen, Wugu Township, Taipei County (TW)

(73) Assignee: Taiwan Suncagey Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/845,777

(22) Filed: Jul. 29, 2010

(51) Int. Cl.
*H01R 12/24* (2006.01)

(52) U.S. Cl. ..... 439/495

(58) Field of Classification Search ..... 439/260, 439/495, 492
See application file for complete search history.

(56) References Cited

U.S. PATENT DOCUMENTS 5,785,549 A * 7/1998 Takayasu ..... 439/495
6,851,968 B2 * 2/2005 Tsunematsu ..... 439/495
7,040,917 B2 * 5/2006 Yagi et al. ..... 439/495
7,112,079 B2 * 9/2006 Miura et al. ..... 439/260
2010/0184317 A1 * 7/2010 Sunaga ..... 439/260

* cited by examiner

*Primary Examiner* — Neil Abrams
*Assistant Examiner* — Phuong T Nguyen
(74) *Attorney, Agent, or Firm* — Leong C. Lei

(57) ABSTRACT

An electrical connector includes a housing, a conductive terminal, and a pressing member. The conductive terminal is received and fixed in the housing. The conductive terminal includes a fixing arm and a depressed arm extending in the same direction and substantially parallel to each other. The depressed arm has an end forming a depressed portion. The fixing arm is fixed with respect to the housing. The fixing arm has a side forming an engaging portion for electrically engaging an electrical cable and an opposite side forming at least one abutment portion positioned against an inner wall of the housing. The pressing member includes a pivot, which is extended in a given direction to form a depressing portion that is operable to depress the depressed arm. The pressing member is movable to switch between an open condition and a clamped condition.

4 Claims, 6 Drawing Sheets

STRUCTURE OF CONDUCTIVE TERMINAL OF ELECTRICAL CONNECTOR

TECHNICAL FIELD OF THE INVENTION

The present invention generally relates to a conductive terminal of an electrical connector, and more particularly to a conductive terminal of an electrical connector that has a structure that is simple and cost-saving.

DESCRIPTION OF THE PRIOR ART

To ensure a desired electrical connection with a flexible circuit board, such a flexible circuit board is often coupled to an electrical connector. An electrical connector of such a purpose is often composed of a housing, conductive terminals, and a pressing member. When the pressing member of the electrical connector is operated, the pressing member acts upon the conductive terminals to have the terminals depressed against the flexible circuit board.

As shown in FIG. 6, which schematically illustrates a conventional electrical connector, the conventional connector comprises a housing 1, conductive terminals 2, and a pressing member 3. Each of the conductive terminals 2 is received and fixed inside the housing 1. The conductive terminal 2 comprises a fixing arm 21, a connection arm 24, and a depressed arm 22. The depressed arm 22 has an end forming a depressed portion. The connection arm 24 has one side forming an engaging portion 25 for electrically engaging an electrical cable. The fixing arm 21 is fixed with respect to the housing 1. The pressing member 3 comprises a pivot 31 that is extended in a given direction to form a depressing portion 32 that is operated to depress the depressed arm 22. The pressing member 3 is movable to switch between an open condition and a clamped condition.

With such a structure, when an electrical cable is inserted into the electrical connector, the pressing member 3 is operated in such a way that the pressing member 3 undergoes a movement in a given direction to switch the pressing member 3 to the clamped condition, whereby the engaging portion 25 of the connection aim 24 is brought into electrical engagement and connection with the electrical cable.

Such a conventional electrical connection, when put into operation, shows several drawbacks, which should be improved.

For example, the structure of the conductive terminal 2 of the conventional connector is very complicated, which leads to excessively high cost for manufacturing a mold for making the terminal 2. This requires further improvement.

Thus, the present invention aims to provide a solution for such an improvement in respect of the structure and manufacturing cost of conductive terminals of electrical connectors.

SUMMARY OF THE INVENTION

In view of the above discussed problems, the present invention provides a novel structure of conductive terminals for an electrical connection, which is of a structure that is simple and cost saving.

Thus, the primary objective of the present invention is to provide a conductive terminal of an electrical connector that has a structure that is simple and cost saving.

To achieve the above objective, the present invention provides an electrical connector that comprises a housing, a conductive terminal, and a pressing member. The conductive terminal is received and fixed in the housing. The conductive terminal comprises a fixing arm and a depressed arm extending in the same direction and substantially parallel to each other. The depressed arm has an end forming a depressed portion. The fixing arm is fixed with respect to the housing. The fixing arm has a side forming an engaging portion for electrically engaging an electrical cable and an opposite side forming at least one abutment portion positioned against an inner wall of the housing. The pressing member comprises a pivot, which is extended in a given direction to form a depressing portion that is operable to depress the depressed arm. The pressing member is movable to switch between an open condition and a clamped condition.

The fixing arm of the conductive terminal according to the present invention forms an engaging portion that is electrically engageable with an electrical cable, so that when an electrical cable is inserted into a housing of an electrical connector of the present invention, the engaging portion forms an effective electrical engagement with the electrical cable. Further, the pressing member is operated in such a way that the pressing member undergoes a movement in a given direction to set the pressing member in the clamped condition whereby the electrical connection can securely clamp the electrical cable. With such an arrangement, the present invention makes the structure of electrical connector simple and also simplifies a corresponding mold and thus achieves the goals of reducing costs and providing a practical improvement.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
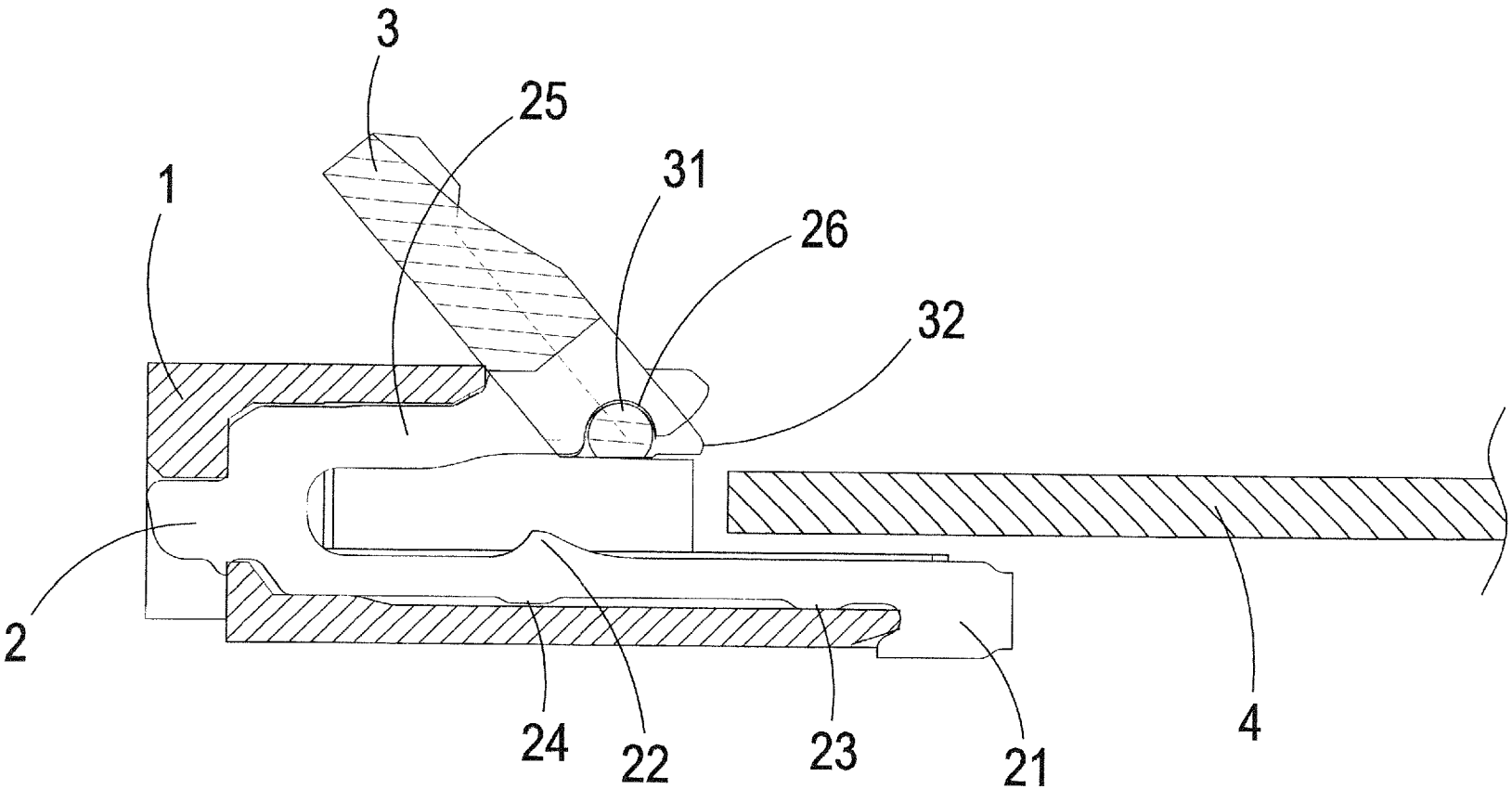
FIG. 1 is a cross-sectional view showing a preferred embodiment according to the present invention.

Referring to FIG. 1, which shows a cross-sectional view of a preferred embodiment according to the present invention, the present invention comprises the following constituent components:

a housing 1;

a conductive terminal 2, which is received and fixed in the housing 1, the conductive terminal 2 comprising a fixing arm 21 and a depressed arm 25 extending in the same direction and substantially parallel to each other, wherein the depressed arm 25 has an end forming a depressed portion 26 and the fixing arm 21 is fixed with respect to the housing 1, the fixing arm 21 having a side forming an engaging portion 22 for electrically engaging an electrical cable 4 and an opposite side forming at least one abutment portion 23 positioned against an inner wall of the housing 1, the fixing arm 21 forming, at the same side as the abutment portion 23, a support portion 24; and a pressing member 3, which comprises a pivot 31, the pivot 31 being extended in a given direction to form a depressing portion 32 that is operated to apply a force to and thus depress the depressed arm 25, the pressing member 3 being movable to switch between an open condition and a clamped condition.

In the embodiment, the abutment portion 23 is arranged as a single one.

Figure 2:
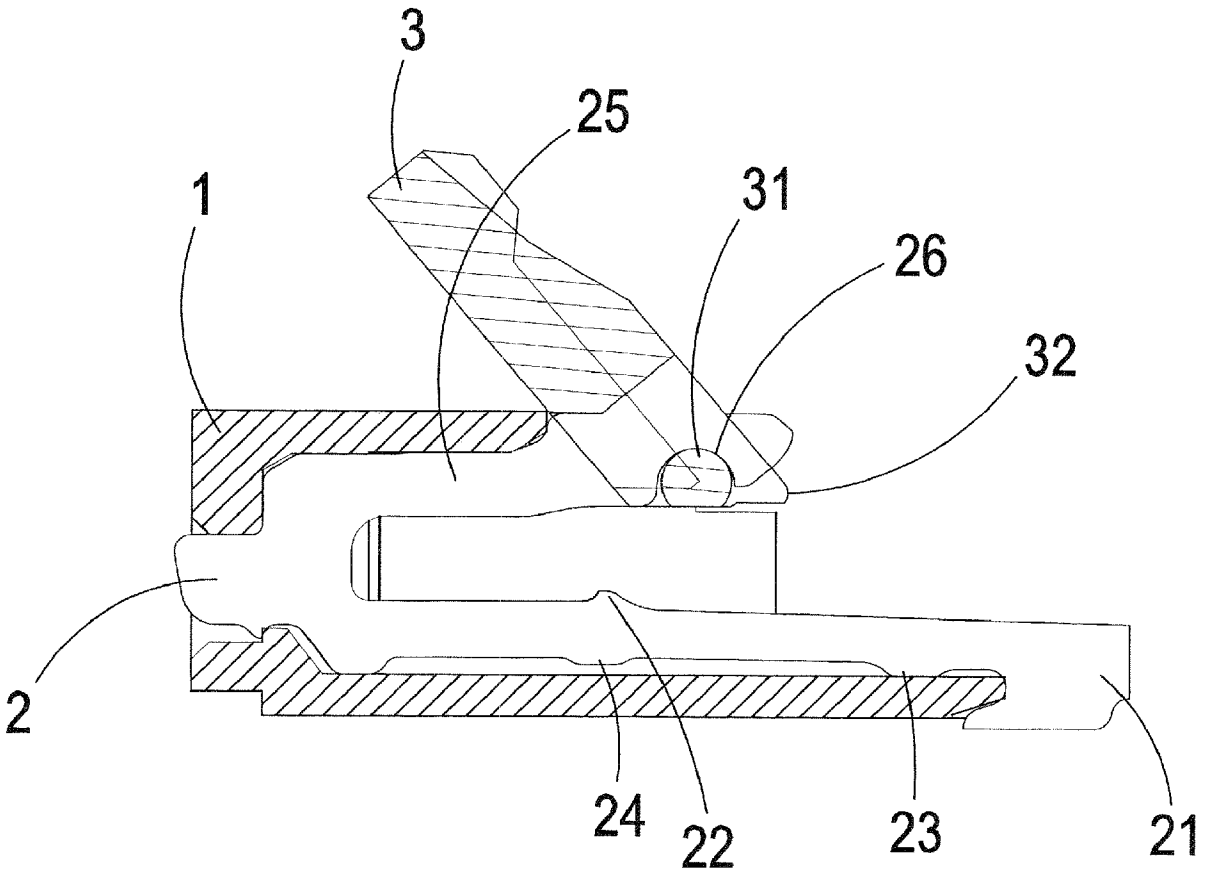
FIG. 2 is a cross-sectional view showing another embodiment according to the present invention.

Referring to FIG. 2, which shows a cross-sectional view of another embodiment according to the present invention, the present invention comprises the following constituent components:

a housing 1;

a conductive terminal 2, which is received and fixed in the housing 1, the conductive terminal 2 comprising a fixing arm 21 and a depressed arm 25 extending in the same direction and substantially parallel to each other, wherein the depressed arm 25 has an end forming a depressed portion 26 and the fixing arm 21 is fixed with respect to the housing 1, the fixing arm 21 having a side forming an engaging portion 22 for electrically engaging an electrical cable and an opposite side forming at least one abutment portion 23 positioned against an inner wall of the housing 1, the fixing arm 21 forming, at the same side as the abutment portion 23, a support portion 24; and a pressing member 3, which comprises a pivot 31, the pivot 31 being extended in a given direction to form a depressing portion 32 that is operated to apply a force to and thus depress the depressed arm 25, the pressing member 3 being movable to switch between an open condition and a clamped condition.

In the embodiment, the abutment portions 23 are arranged as two such portions, so that improved structural stability of the fixing arm 21 fixed in the housing 1 can be realized.

Figure 3:
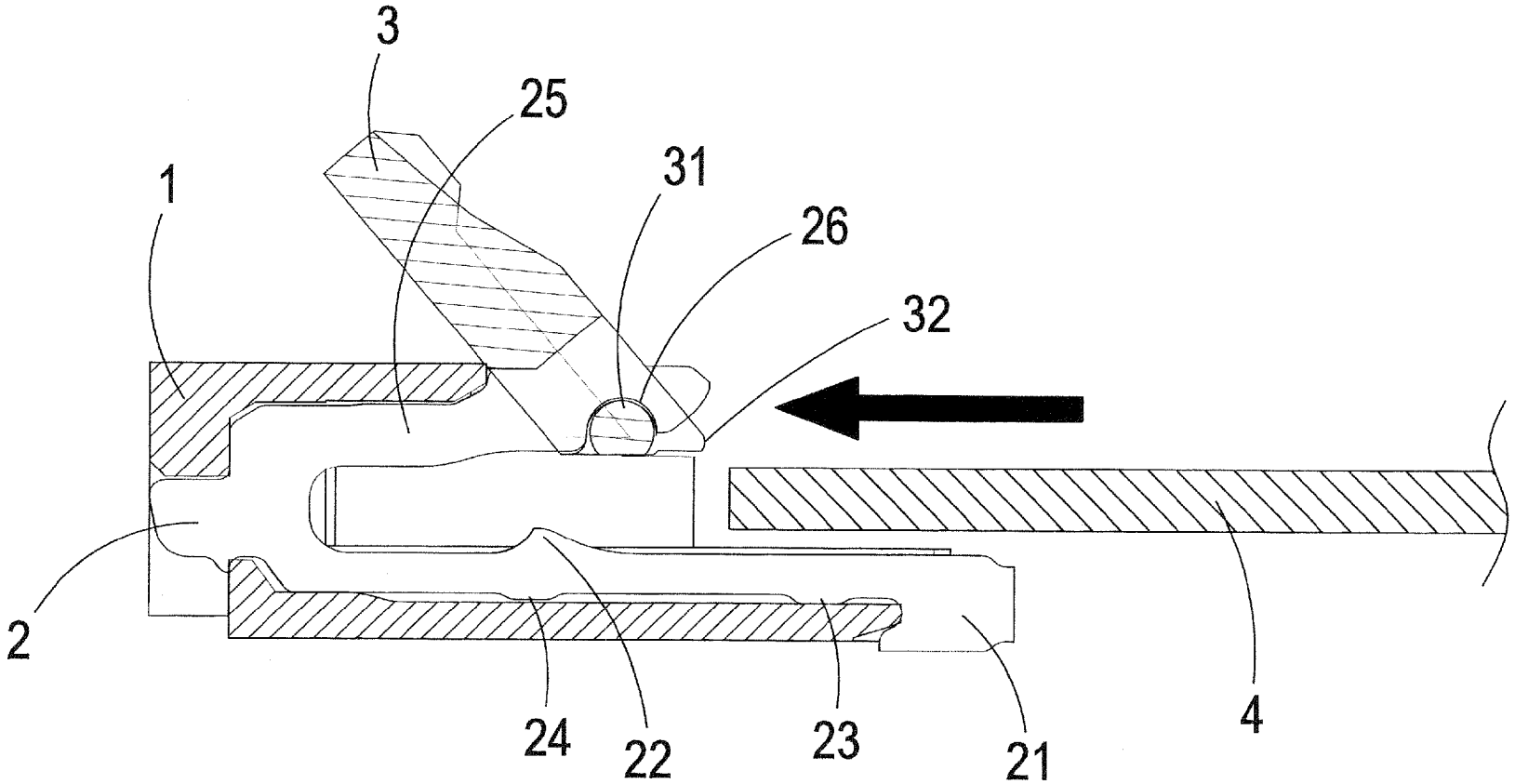
FIG. 3 is a cross-sectional view illustrating a first phase of an operation of the preferred embodiment of the present invention.
Figure 4:
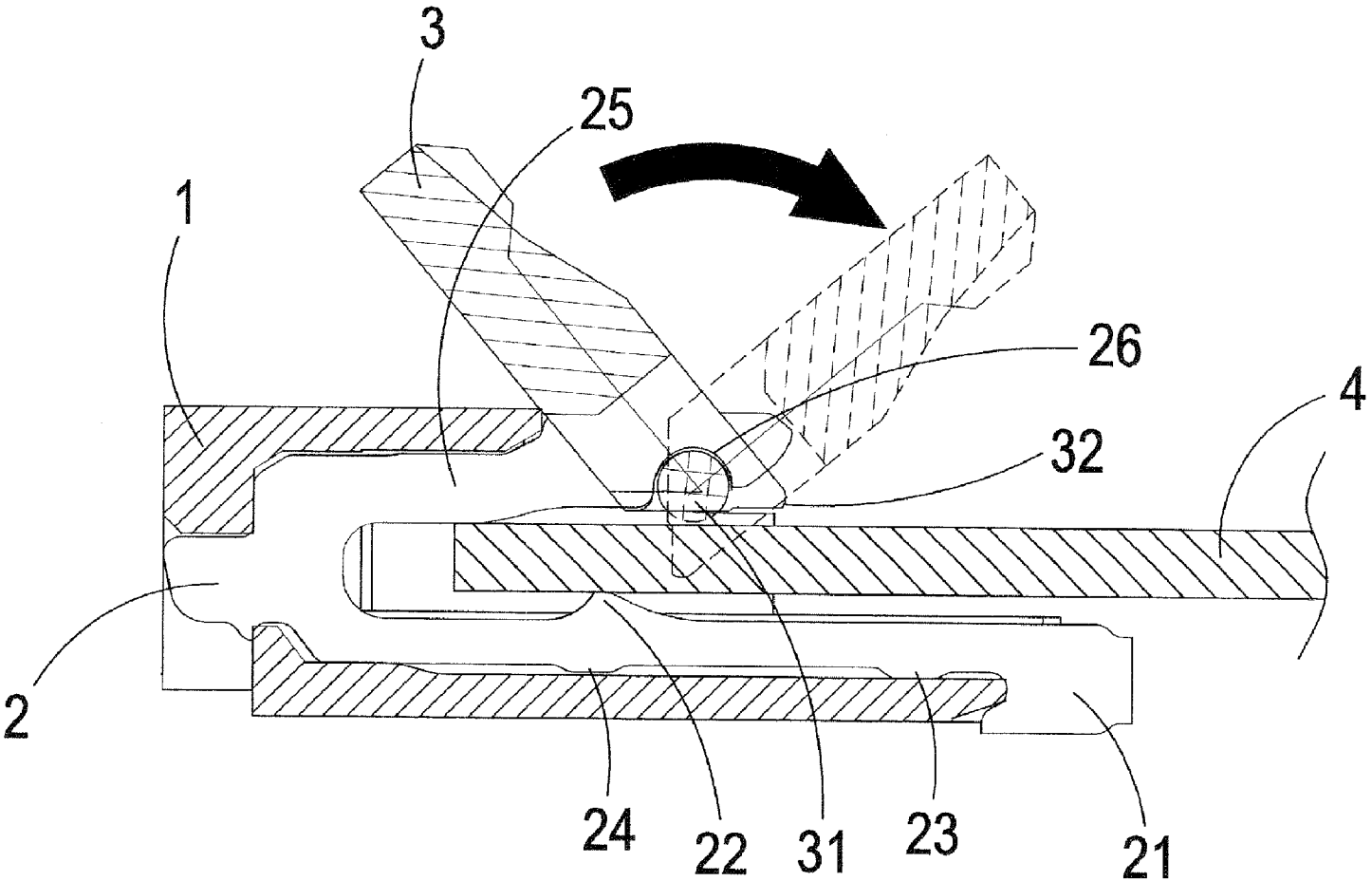
FIG. 4 is a cross-sectional view illustrating a second phase of the operation of the preferred embodiment of the present invention.
Figure 5:
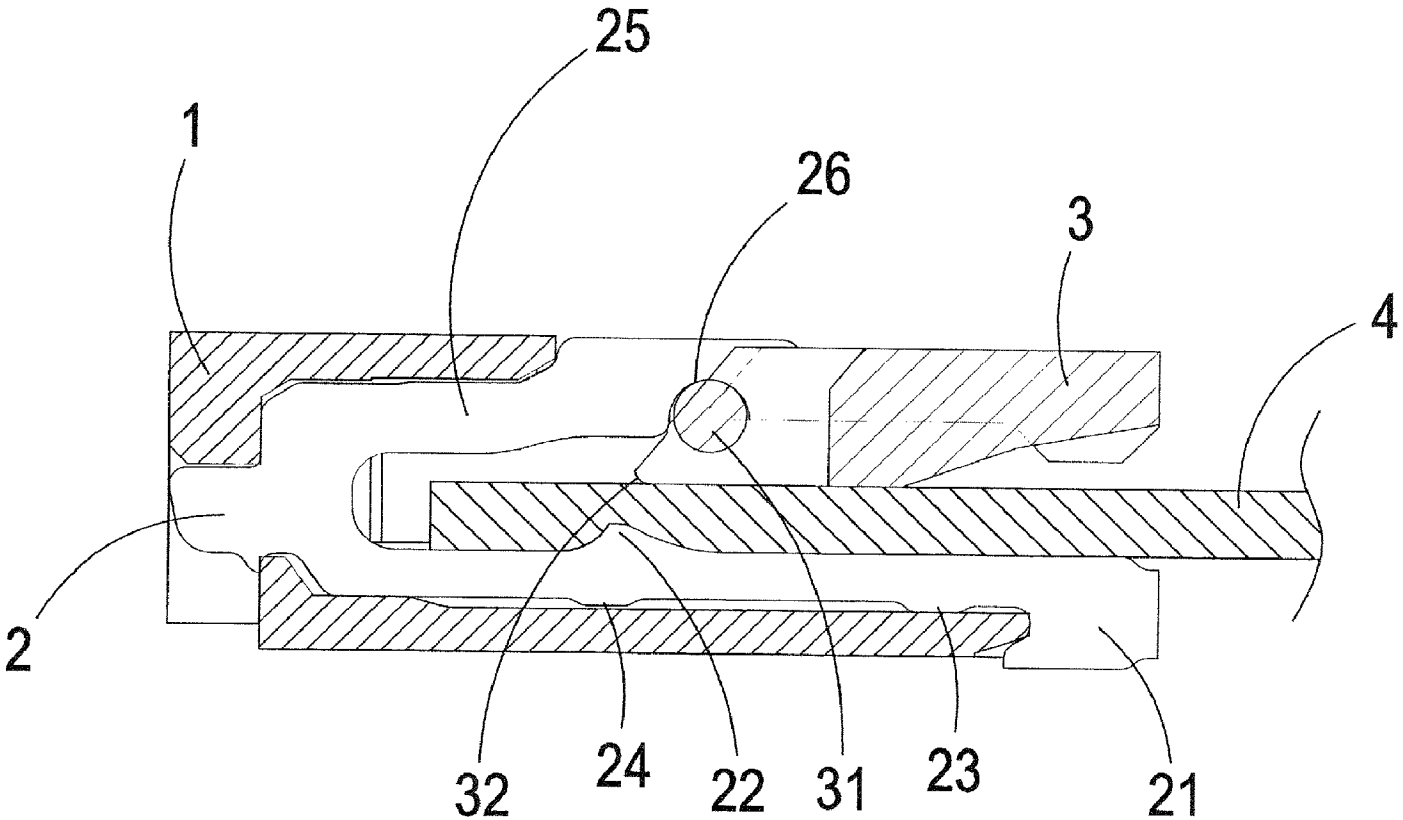
FIG. 5 is a cross-sectional view illustrating a third phase of the operation of the preferred embodiment of the present invention.
Figure 6:
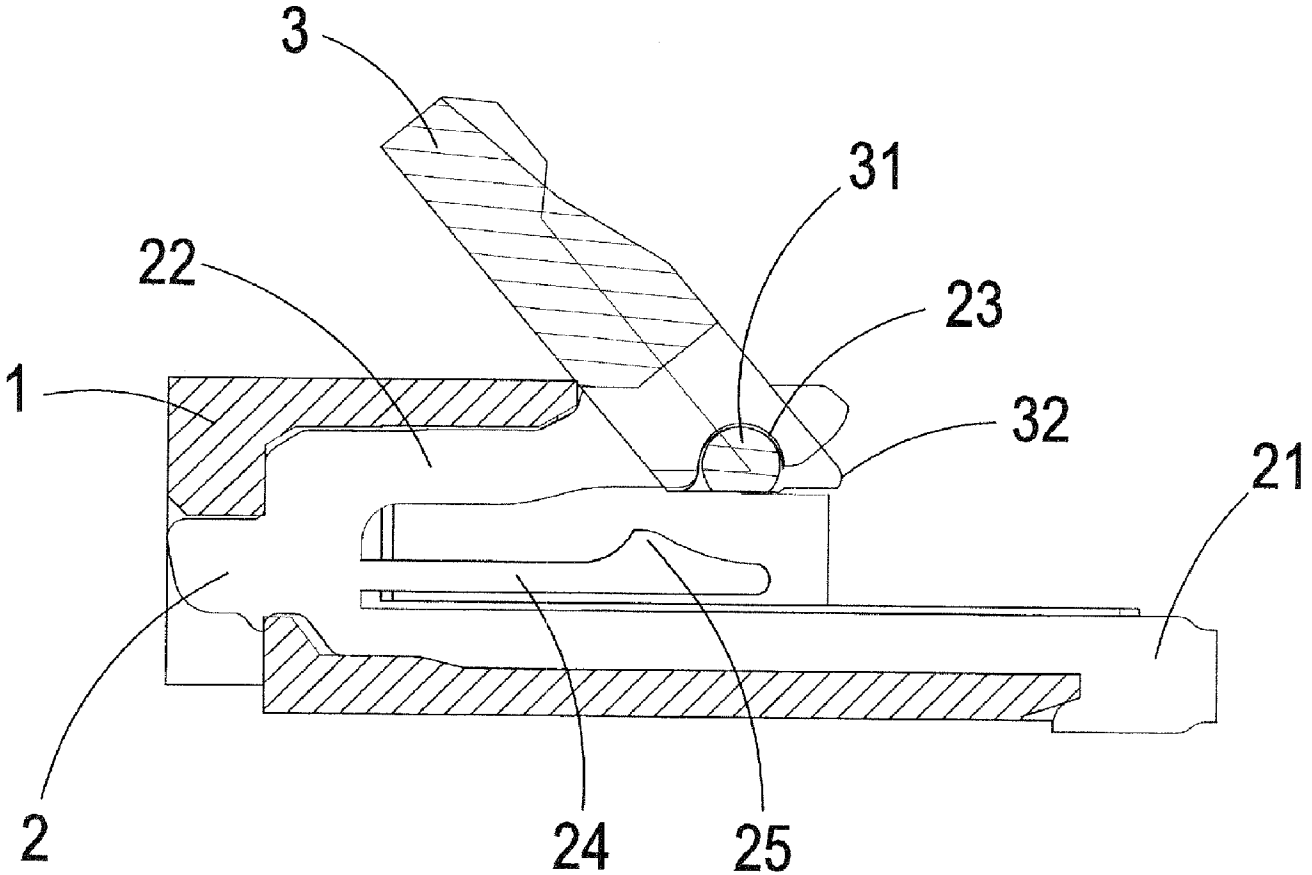
PRIOR ART FIG.6
FIG. 6 is a cross-sectional view showing a conventional electrical connector.

According to the above discussed structure and arrangement, the operation of the present invention will be described as follows, reference being had to FIGS. 3-5, which demonstrate an operation of the present invention. Since the present invention comprises a conductive terminal 2, which has a fixing aim 21 and a depressed arm 25 extending in the same direction and substantially parallel to each other and since the fixing arm 21 has a side forming an engaging portion 22 for electrically engaging an electrical cable 4, when an electrical cable 4 is inserted into the housing 1, the pressing member 3 is operated in such a way that the pressing member 3 undergoes a movement in a given direction to securely fix the electrical cable 4 inside the housing 1 and also to cause the engaging portion 22 to electrically engage the electrical cable 4.

With the above discussed structure and operation, the present invention makes the conductive terminal 2, which serves as a conductive terminal of an electrical connector, simple in structure, whereby a mold for making the terminal can be simplified to thereby achieve the goals of reducing cost and showing a practical improvement.

As compared to the existing techniques, the present invention, when put into practice, shows the following advantages:

The present invention provides a conductive terminal 2 for an electrical connector, which comprises a fixing arm 21 having one side forming an engaging portion 22 for electrically engaging an electrical cable 4, whereby with the arrangement of the engaging portion 22, when an electrical cable 4 is inserted into the housing 1, the engaging portion 22 can be operated to form electrical engagement and connection with the electrical cable 4. With such an arrangement, the structure of conductive terminal 2 is simplified, and thus the cost of making a corresponding mold is reduced, thereby showing a practical improvement in respect of reduction of manufacturing cost.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electrical connector, comprising:

a housing;

a conductive terminal, which is received and fixed in the housing, the conductive terminal comprising a fixing arm and a depressed arm extending in the same direction and substantially parallel to each other, wherein the depressed arm has an end forming a depressed portion and the fixing arm is fixed with respect to the housing, the fixing arm having a side forming an engaging portion adapted to electrically engage an electrical cable and an opposite side forming at least one abutment portion positioned against the housing; and a pressing member, which comprises a pivot, the pivot being extended in a given direction to form a depressing portion that is operable to depress the depressed arm, the pressing member being movable to switch between an open condition and a clamped condition.

2. The electrical connector according to claim 1, wherein the fixing arm forms a support portion 24 at the same side as the abutment portion.

3. The electrical connector according to claim 1, wherein the abutment portion is arranged as a single one.

4. The electrical connector according to claim 1, wherein the abutment portions are arranged as two such portions.

* * * * *